United States Patent [19]

Barr

[11] Patent Number: 4,602,736

[45] Date of Patent: Jul. 29, 1986

[54] TWO-WAY MAILING ENVELOPE

[76] Inventor: Arthur C. Barr, 1714 Yahara Pl., Madison, Wis. 53704

[21] Appl. No.: 703,792

[22] Filed: Feb. 21, 1985

[51] Int. Cl.[4] ..... B65D 27/06

[52] U.S. Cl. ..... 229/73

[58] Field of Search ..... 229/73

[56] References Cited

U.S. PATENT DOCUMENTS

| | | | |
|---|---|---|---|
| 690,500 | 1/1902 | West . | |
| 886,449 | 5/1908 | West . | |
| 1,064,302 | 6/1913 | Donohue . | |
| 1,373,512 | 4/1921 | Kuhhorn . | |
| 2,201,538 | 5/1940 | Holden | 229/73 |
| 2,527,925 | 10/1950 | Frampton | 229/73 |
| 2,695,130 | 11/1954 | Covan | 229/73 |
| 2,941,711 | 6/1960 | Biek | 229/73 |
| 3,073,509 | 1/1963 | Schuessler | 229/73 |
| 3,113,716 | 12/1963 | Howard | 229/73 |
| 3,270,948 | 9/1966 | Donovan . | |
| 3,411,699 | 11/1968 | Pine et al. | 229/73 |
| 3,558,040 | 1/1971 | Drueger . | |
| 4,308,987 | 1/1982 | Solomon . | |
| 4,334,618 | 6/1982 | Buescher | 229/73 |
| 4,382,539 | 5/1983 | Krosman . | |
| 4,445,635 | 1/1984 | Barr . | |

*Primary Examiner*—Stephen P. Garbe
*Attorney, Agent, or Firm*—Vernon J. Pillote

[57] ABSTRACT

A two-way mailing envelope formed from a single blank having generally rectangular front and rear panels integrally joined together along an upper fold line, and first and second closure flap integrally joined to the lower edges of the respective front and rear panels along lower fold lines. Mailing address indica are provided on the front side of the envelope in a mailing address read area and a return address is provided on the front side of the envelope at a level above the mailing address. During the initial mailing, the first closure flap on the lower edge of the front panel is folded upwardly and sealed to the rear panel of the envelope. The envelope is opened by rupturing the rear panel along the first flap fold line and the envelope is resealed for re-mailing by folding the second closure flap on the rear panel upwardly and sealing the same against the front panel. A second closure flap is dimensioned so that it covers the original mailing address while leaving the return address on the front of the envelope exposed. In one embodiment, a re-mailing address is printed on the second closure flap. In another embodiment, the return address indicia is printed on the front of the envelope so that at least the zip code of the return address extends into the mailing address read area, and the second closure flap is dimensioned so that it covers the original mailing address but leaves the return address indicia exposed for sensing by automatic mail processing equipment.

6 Claims, 14 Drawing Figures

FIG. 4.
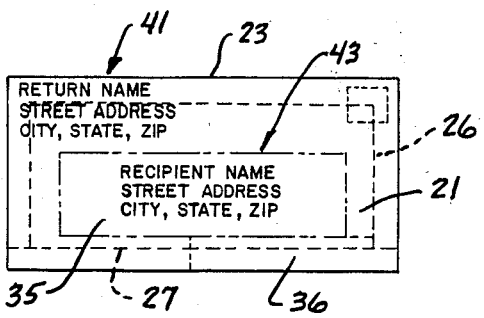
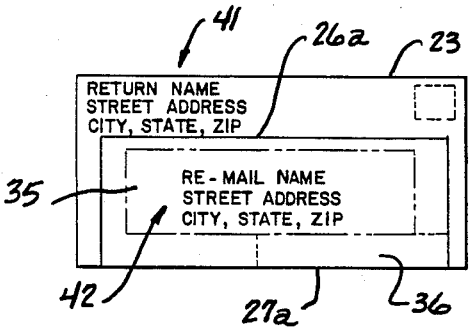
FIG. 6.
FIG. 5.
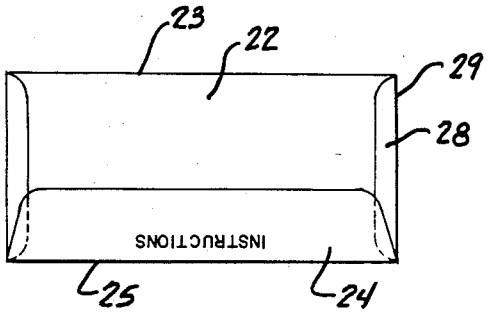
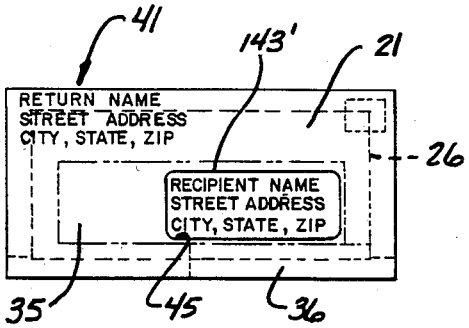
FIG. 7.

Fig. 11.
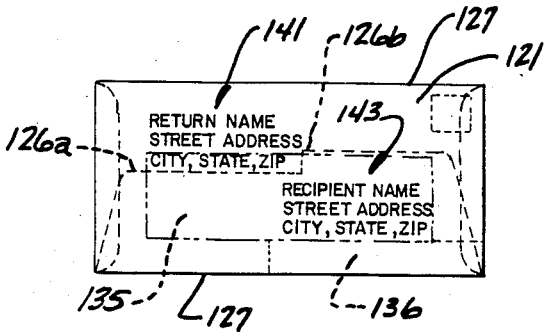
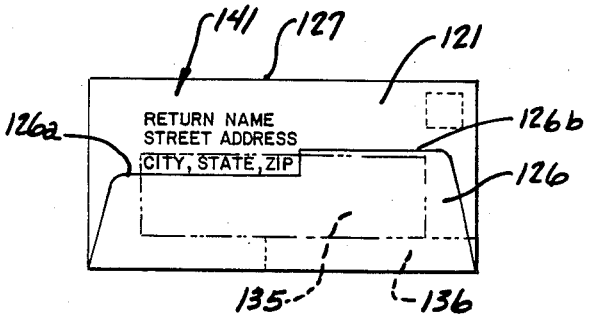
Fig. 13.
Fig. 12.
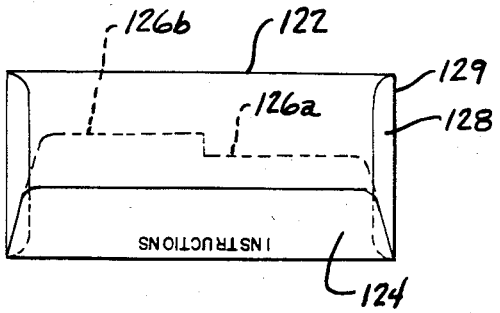
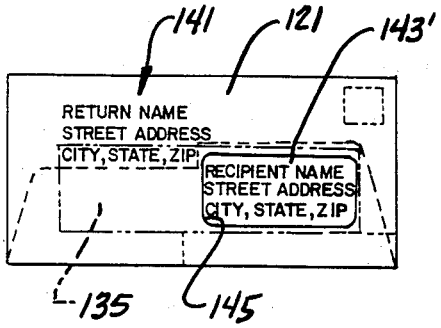
Fig. 14.

TWO-WAY MAILING ENVELOPE

BACKGROUND OF THE INVENTION

Present automatic mail processing machinery have optical character readers which can read certain address indicia printed in a preselected mailing address read area on the front of an envelope. The mailing address read area has an upper read area limit spaced a preselected distance above the lower edge of the envelope, and the upper read area limit, even on minimum size envelopes, is spaced a substantial distance below the upper edge of the envelope to allow an upper area on the front of the envelope for a return address and for postage. After the optical character reader has read the mailing address, it will print a bar code representing at least the zip code in a bar code read area on the front of the envelope, which bar code read area is below the mailing address read area and extends along the lower right edge of the envelope a preselected height and width. The bar code printed by the optical character reader is used in bar codes sorters and the like in further automated processing of the mail.

It is known to provide two-way or re-mailable mailing envelopes. Some two-way envelopes such as disclosed in U.S. Pat. Nos. 690,500; 1,373,512; 3,270,948; 3,558,040 and 4,445,635, provide envelopes with a short flap on the upper edge of the front panel of the envelope adapted to be folded over and sealed to the rear panel of the envelope in the first mailing of the envelope, and a short flap on the upper edge of the rear panel of the envelope adapted to be folded over and sealed to the front panel on the envelope for re-mailing. The short re-mailing flap on such envelopes only covers the upper return address and postage area on the front of the envelope. Difficulties are encountered if such envelopes are processed during return mailing by automatic mail processing machines since the original mailing address and any bar code applied to the envelope by optical character readers during the initial mailing, remains exposed on the front of the envelope. Some other two-way envelopes such as disclosed in U.S. Pat. Nos. 886,449; 1,064,302; 4,308,987 and 4,382,539 provide envelopes with a short flap on the upper edge of one of the side panels of the envelope and a long flap on the upper edge of the other of the side panels of the envelope, with the large flap being dimensioned to substantially cover a side panel of the envelope when it is folded thereover. Use of large flaps sufficient to cover the entire side of an envelope substantially increases the amount of material required to produce the re-mailable envelope. Further, when the large flap is used as the return mailing closure flap, it must be tucked into the envelope pocket during the initial mailing. If the large return flap is tucked into the envelope pocket in an unfolded condition, it is difficult to withdraw from the envelope pocket for use in re-mailing. The large return flaps are sometimes folded upon themselves and inserted into the pocket in the envelope. While this facilitates withdrawal of a return flap from the pocket, it presents some difficulties during insertion of enclosures into the envelope particularly by automatic insertion machines prior to the original mailing.

SUMMARY OF THE INVENTION

It is an object of the present invention to provide a two-way mailing envelope which overcomes the above disadvantages of prior two-way mailing envelopes and which minimizes the amount of paper stock required for making the envelope, and which can be processed in automatic mail processing machines during the initial mailing and also during the return mailing.

Accordingly, the present invention provides a two-way mailing envelope adapted for either manual or automatic processing by mail processing machinery having optical character readers which can read address indicia in a preselected mailing address read area on the front of the envelope and print a bar code on a bar code read area on the front of the envelope below the mailing address read area. The mailing address read area on the envelope has an upper read area limit spaced a preset distance above the lower edge of the envelope and also spaced below the upper edge of the envelope to provide an upper area on the front of the envelope for a return address and for postage. The two-way mailing envelope is formed from a single elongated blank comprising a rectangular front panel and a rectangular rear panel integrally joined at their upper side edges along a panel fold line, a first closure flap integrally joined to the lower side edge of the front panel and a second closure flap integrally joined to the lower side edge of the rear panel. The front panel has mailing address indicia in the mailing address read area and arranged for manual and optical character reading when the envelope is oriented with the panel fold line at the top of the envelope, and return address indicia on the front panel at a location above the mailing address area and also arranged for reading when the envelope is oriented with the panel fold line at the top of the envelope. The second closure flap is initially folded relative to the rear panel and inserted into the envelope pocket between the front and rear panels and the first closure flap is adapted to be folded relative to the front panel into overlying relation with a portion of the rear panel and sealed to the rear panel for the first mailing of the envelope. The second closure flap is removable from the envelope pocket after the envelope is opened by rupturing the first end flap and the second closure flap is foldable upwardly into overlying relation with the lower portion of the front panel and is sealed to the front panel of the envelope. The second closure flap is so dimensioned that, when folded upwardly into overlying relation with the lower portion of the front panel, it covers the bar code and mailing address indicia on the front panel and has its free edge spaced below the return address indicia on the front panel of the envelope so that the original return address remains exposed during remailing.

In one embodiment, the second closure flap can be preprinted with a re-mailing address so that, when the second closure flap is folded upwardly and sealed in overlying relation with the lower portion of the front panel, it not only covers the original mailing address and any bar code applied to the front of the envelope, but also provides a re-mailing address for use during return of the envelope.

In another embodiment of the invention, the second closure flap can be blank and the original return address printed on the front of the envelope such that at least the zip code portion of the return address extends into the mailing address read area. The second closure flap is dimensioned so that, when folded upwardly into overlying relation with the lower portion of the front panel, it covers the original mailing address but leaves the original return address exposed with its zip code in the mailing address read area so that the optical character readers of the automatic mail processing machinery will read the zip code of the original return address and apply a bar code to the second closure flap for use in subsequent automated mail processing. In this embodiment, it is not necessary to preprint the second closure flap with a re-mailing name and address, so that the envelope can be completely formed with the second closure flap tucked into the pocket of the envelope, before applying any address indicia to the envelope, and the preformed envelope can thereafter be printed with the appropriate return address indicia in the proper location on the envelope.

BRIEF DESCRIPTION OF THE DRAWINGS

FIG. 4 is a front view of the re-mailable envelope in a completely closed condition and addressed for mailing;

FIG. 5 is a rear view of the re-mailable envelope of FIG. 4;

FIG. 6 is a front view of the re-mailable envelope in a completely folded condition for return mailing; and FIG. 7 is a front view of a modified form of a remailable envelope having a viewing window.

FIG. 11 is a front view of the re-mailable envelope of FIG. 10 in a completely closed condition and ready for its first mailing;

FIG. 12 is a rear view of the re-mailable envelope of FIG. 11;

FIG. 13 is a front view of the re-mailable envelope in a completely folded condition ready for return mailing; and FIG. 14 is a front view of further modified form of a re-mailable envelope having a viewing window.

DETAILED DESCRIPTION

Figure 1:
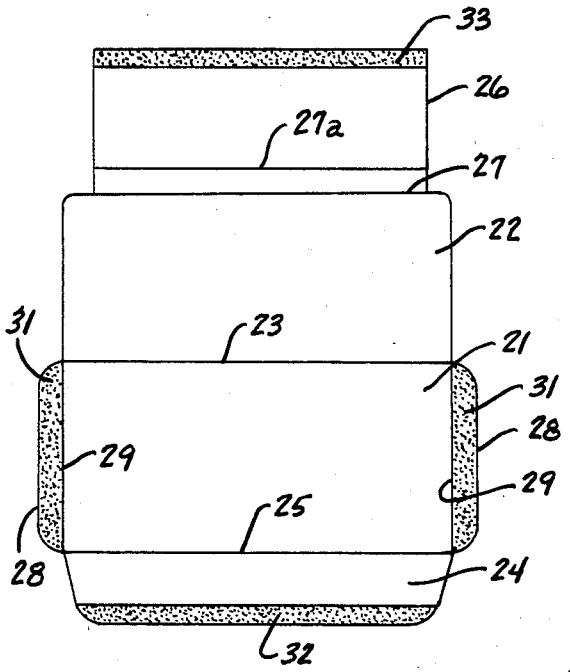
FIG. 1 is a plan view of the inner face of a two-way mailing envelope blank.

Automated mail processing equipment is presently capable of handling mail pieces between a minimum size of $3\frac{1}{2}''$ wide by $5''$ long and a maximum size of $6\frac{1}{8}''$ wide and $11\frac{1}{2}''$ long. The mailing envelope of the present invention can be of any size within the minimum and maximum sizes capable of being processed on automated mail handling equipment. In the several embodiments illustrated, the two-way mailing envelope is illustrated on approximately one-third scale and illustrates a two-way mailing envelope having a width of about $3\frac{3}{4}''$ and a length of about $7\frac{3}{4}''$.

The two way mailing envelope is formed from a single blank and includes a generally rectangular front panel 21 and a generally rectangular rear panel 22 integrally joined together at their upper side edges along a fold line 23. A first closure flap 24 is integrally joined to the lower side edge of the front panel 21 along a first flap fold line 25 and a second closure flap 26 is integrally joined to the lower side edge of the rear panel 22 along a second flap fold line 27. Edge flaps 28 are integrally joined to the end edges of one of the panels 21 along fold lines 29. The front and rear panels 21 and 22 are adapted to be folded along the fold line 23 with their inner sides in face-to-face contact and the end flaps 28 are adapted to be folded inwardly into overlying relation with the rear panel adjacent the end edges thereof. Adhesive 31 is provided on the inner face of the end flaps 28 and, when the front and rear flaps are folded into overlapping relation and the end flaps folded inwardly to overlie the rear panel, the end flaps are sealed to the outer face of the rear panel to form a pocket between the front and rear panels. An adhesive strip 32 is provided on the inner face of the first end flap 24 for sealing the first end flap during the initial mailing, and an adhesive strip 33 is provided on the inner face of the second closure flap 26, for use in sealing the second closure flap during re-mailing.

In the two-way mailing envelope, the second closure flap 26 is inserted into the pocket between the front and rear panels 21 and 22 during the initial mailing. In order to facilitate infolding of the second closure flap during formation of the two-way envelope, the end edges of the second closure flap 26 are advantageously spaced inwardly from the end edges of the rear panel 22 a distance approximating the width of the end flaps 28 on the front panel. Further, in order to facilitate opening of the envelope after its initial mailing, the fold line 27 between the lower edge of the rear panel and the second closure flap 26 is preferably spaced inwardly from the lower fold line 25 between the front panel and the first closure flap. Thus, the rear panel 22 has a width measured between the fold lines 23 and 27 which is somewhat less than the width of the front panel measured between the fold lines 23 and 25. After the initial mailing, the envelope is opened along the lower fold line 25. In order to re-mail the envelope, the second closure flap 26 is withdrawn from the pocket between the front and rear panels and the second closure flap then folded along a second fold line **27*a* over the lower edge of the front panel 25** and into overlapping relation with the lower portion of the front panel.

Figure 3:
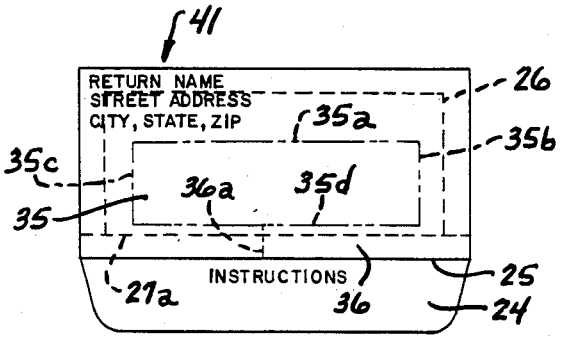
FIG. 3 is a front view of a re-mailable envelope formed from the blank shown in FIGS. 1 and 2 in an opened condition for receiving enclosures.

Present automatic mail processing equipment utilizes optical character readers which read at least portions of a mailing address indicia when located in a preselected mailing address read area on the front of the envelope. The mailing address read area 35 is indicated in FIGS. 3–5 by a solid line interrupted by a double dash and the present mailing address read area delimited by the U.S. Postal Service has its upper read area limit **35*a* spaced $2\frac{1}{4}''$ above the lower edge of the envelope and its end edges 35*b*, 35*c* spaced inwardly $1''$ from the end edges of the envelope, and with its bottom edge 35*d* spaced above the lower edge of the envelope about $\frac{5}{8}''$ to provide a bar code read area 36 on the front side of the envelope below the mailing address read area delimited by the U.S. Postal Service 35. The present bar code read area has its upper limit spaced $\frac{5}{8}''$ from the lower edge of the envelope and a length of $4\frac{1}{2}''$ measured from the right edge of the envelope. In the embodiment illustrated, the left end of the bar code read area extends to a point indicated by line 36*a*. The optical character readers are adapted to read at least the zip code of the mailing address in the mailing address read area 35 and to print a bar code representing at least the zip code in the zip code read area 36**. The bar code so printed is utilized in bar code sorters and the like for further automated processing of the mail.

Two-way mailing envelopes are commonly used by companies who mail out an invoice, statement, advertising or the like in the envelope during the initial mailing and which desire to have the envelope returned either to the original mailer at its original mailing address or to some other designated name or address. In this embodiment, the envelopes are preprinted with return address indicia designated generally by the numeral 41, in a return address area on the front side of the envelope at a location above the mailing address read area 35. The return address indicia generally includes the return name and the delivery address such as the street address or post office box, and the city, state and zip code of the original mailer. The return address indicia is commonly located in the upper left portion of the front side of the envelope so that the upper right portion of the envelope above the mailing address read area can be used as a postage area. The return address indicia is printed on the envelope in such a manner that the indicia is upright so that it can be read when the panel fold line 23 of the envelope is uppermost and with the city, state and zip code in the lowermost line of the return address. Remailing address indicia indicated generally by the numeral 42 is provided on the second closure flap 26. This remailing address indicia generally includes the re-mail name and address; that is, the name to which the envelope is to be re-mailed, along with its delivery address such as the street address or post office box and the city, state and zip code. This remailing address indicia is printed on the second closure flap 26 in such a manner that it is upright and can be read by an individual or the optical character readers of automatic mail processing equipment when the second closure flap is folded upwardly onto the front side of the envelope as shown in FIG. 6 and with the city, state and zip code in the lowermost line of the remailing address. In addition, the re-mail address indicia is located on the second closure flap at a location such that it is disposed within the mail read area 35 on the front of the envelope, when the second closure flap is sealed to the front side of the envelope during re-mailing. As will be seen from FIG. 6, the remail address indicia 42 is spaced above the bar code read area 36 so that optical character readers can read the remail address and print a bar code corresponding thereto in the bar code read area, during remailing of the two-way envelope.

Figure 2:
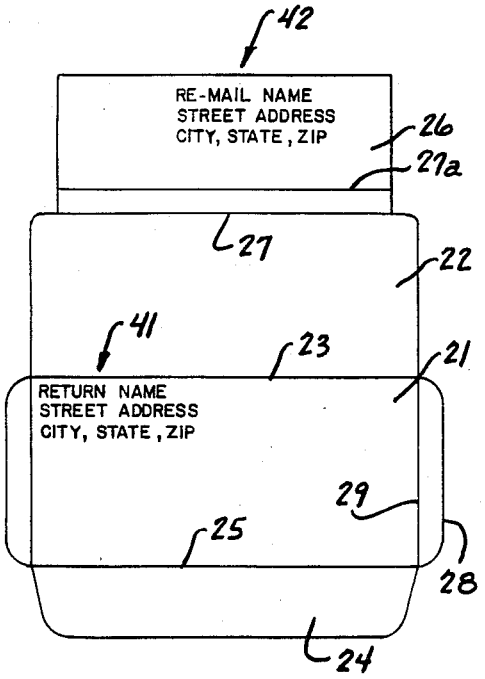
FIG. 2 is a plan view of the outer face of a two-way mailing envelope blank.

As previously described, the second closure flap is inserted into the pocket between the front and rear panels during the initial mailing and is preferably folded into the pocket during the initial folding and forming of the envelope. Accordingly, the re-mailing address indicia 42 is advantageously printed on the second closure flap before folding the blank as shown in FIG. 2. The return address indicia is also advantageously printed on the front panel 21 of the envelope at the same time that the re-mailing address indicia is printed on the second closure flap. As will be readily understood, the re-mailing indicia 42 can be the same as the return name indicia 41, if it is desired to have the two-way envelope returned to the original mailer at the original mailing address. Alternatively, the re-mailing name and address can be a different name and/or address, if desired.

Mailing address indicia designated generally by the numeral 43 including the recipient's name, the recipient's delivery address such as the street address or box number and city, state and zip code number of the recipient are applied to the front panel 21 within the borders of the mailing address read area 35 as shown in FIG. 4 and the mailing address indicia is printed so that it is upright to enable manual reading when the envelope is positioned with the panel fold line 23 uppermost or at the top, with the city, state and zip code of the recipient in the lowermost line of the mailing address. In the form shown in FIGS. 1–6, the mailing address indicia 43 is printed on the front panel 21 of the envelope. In the embodiment of FIG. 7, the front panel 21 of the envelope is provided with a window 45 located within the boundaries of the mailing address read area, and the mailing address is provided on an insert in the envelope positioned so that the mailing address can be read through the window.

After the proper enclosures are inserted into the envelope pocket, the first closure flap 24 on the front panel is folded upwardly and rearwardly into overlapping relation with the rear panel 22 and sealed by the adhesive 32. The mailing indicia 43, whether printed on the front panel 21 or readable through the window 45, is located within the mailing address read area so that it can be read by optical character readers of automatic mail processing equipment. The automatic mail processing equipment will then print a bar code in the bar code read area 36 on the front of the envelope representing at least the zip code, which bar code is utilized in further automated processing of the mail. When the envelope is received by the named recipient, it is opened by rupturing the first closure flap 24 along the first flap fold line 25. This can bve done manually or with automatic letter openers that cut the envelope along the panel fold line 29. Alternatively, a tear strip (not shown) can be provided in the first end flap to facilitate openint. Instructions for opening and returning as indicated at 40 can be printed on the first end flap or on the rear panel 22. For example, the instructions can be as follows: "This is a returnable envelope. Please open with a knife or pencil. Use inside flap to return remittance in this envelope. Place postage stamp on top right corner for returning".

The enclosures can be removed from the opened envelope and the second closure flap then withdrawn from the pocket. After the proper new enclosures are inserted into the envelope pocket, the envelope is resealed for remailing by folding the second closure flap 26 upwardly into overlapping relation with the lower portion of the front panel 21, and by sealing the second closure flap to the front panel with the adhesive 33. The second closure flap, when folded over the front panel, covers the original mailing address 43 and exposes the re-mailing address 42. As previously described, this re-mailing address is located on the second closure flap so as to lie within the boundaries of the mailing address read area 35. Thus, the re-mailing address 42 is in the proper position for reading by automated mail processing equipment which can then print a new bar code in a bar code read area 36 provided by the second closure flap at the front side of the envelope.

Figure 8:
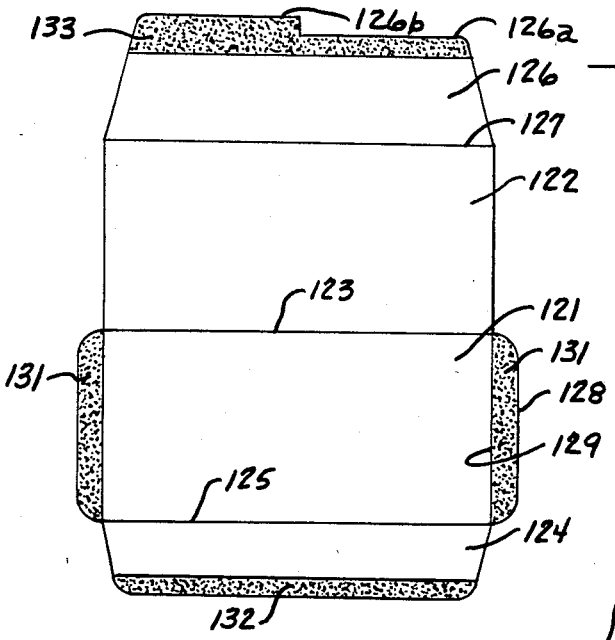
FIG. 8 is a plan view of an inner face of another embodiment of a two-way mailing envelope.
Figure 9:
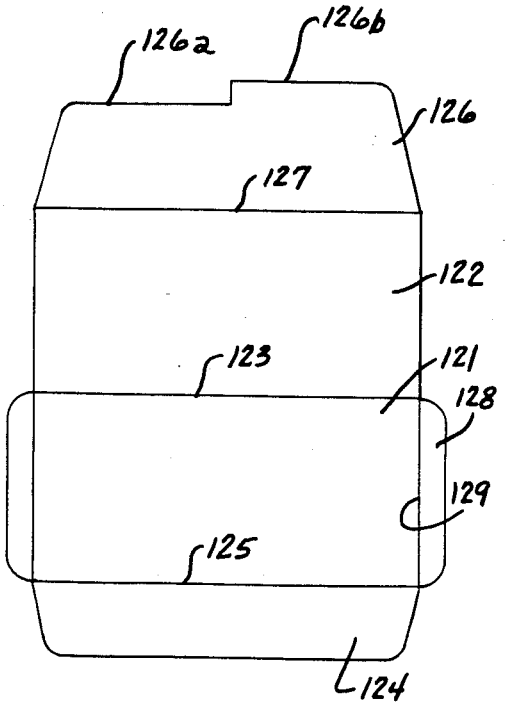
FIG. 9 is a plan view of the outer side of the remailing envelope blank of FIG. 8.
Figure 10:
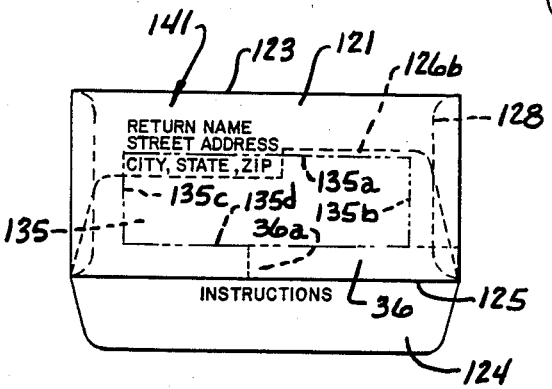
FIG. 10 is a front view of a re-mailable envelope formed from the blank shown in FIGS. 8 and 9 in a folded condition ready for insertion of an enclosure.

The two-way mailing envelope of the embodiment of FIGS. 8–13 is similar to that described in connection with FIGS. 1–6 and like numerals in the one hundred series are used to designate corresponding parts. As shown in FIGS. 8 and 9, the envelope is formed from a flat blank having a rectangular front panel 121 and a rectangular rear panel 122 integrally joined along a panel fold line 123. A first closure flap 124 is joined to the lower edge of the front panel 121 along a first flap fold line 125 and a second closure flap 126 is joined to the rear panel 122 along a flap fold line 127. End flaps 128 are joined to the end edges of one of the panels such as the front panel 121 along fold lines 129 and have adhesive 131 on their inner faces. Adhesive strips 132 and 133 are also provided on the inner faces of the first and second closure flaps 124 and 126 along their free edges. As in the preceding embodiment, the rear panel 122 is folded along line 123 into face-to-face contact with the inner side of the front panel 121 and the end flaps 128 are folded inwardly and sealed to the outer face of the rear panel 122 to form an envelope pocket.

As previously described, the automated mail processing equipment has optical character readers arranged to read at least a portion such as a zip code of an address located within a preselected mailing address read area 135, the mailing address read area has an upper read area limit 135*a* spaced delimited by the U.S. Postal Service about 2¼", from the lower edge of the envelope, end limits 135*b* and 135*c* spaced inwardly about 1" from the ends of the envelope, and a lower limit 135*d* spaced about ⅝" from the lower edge of the envelope to provide a bar code read area 136 on the front of the envelope below the mailing address read area. The present bar code read area delimited by the U.S. Postal Service has its upper limit about ⅝" the lower edge of the envelope and extends from the right edge of the envelope along the lower edge of the envelope for a distance of about 4½".

In this embodiment, return address indicia 141 are printed on the front panel 121 of the envelope at a location such that the return name and street address or post office box number are located above the upper limit 135*a* of the mailing address read area, but the lowermost line of the return address indicia, including the city, state and zip code of the return address, is located so as to extend into the mailing address read area a short distance, preferably no more than about ¼" below the upper mailing address limit 135*a*. The return indicia 141 are printed on the front of the envelope in such a manner as to be upright when the panel fold line 123 is at the top, to enable reading of the return address and also to locate the lowermost or last line of the return address indicia in the mailing address read area.

After the proper enclosures are inserted into the envelope pocket, the first closure flap 124 on the front panel is folded along the line 125 upwardly and rearwardly into overlapping relation with the lower portion of the rear panel 122 to close the envelope. Mailing address indicia designated generally by the numeral 143 and including the recipient's name, street address and city, state and zip code are printed on the front panel 121 of the envelope at a location so as to be within the boundaries of the mailing address read area and preferably spaced below the upper read area limit 135*a* a distance so as to be below the lower or last line of the return address indicia 141. The city, state and zip code of the recipient are in the lowermost line of the mailing address so that the envelope can be processed during the initial mailing by automatic mail processing equipment adapted to read at least a portion of the lowermost line of the mailing address indicia 143 and to print a bar code in the bar code read area representing at least the zip code in the mailing address.

After receipt of the envelope, it is opened by rupturing the first closure flap adjacent the flap fold line 125 and the enclosures are then removed and the second closure flap withdraw from the envelope pocket. The envelope can then be re-mailed after insertion of the proper enclosures in the envelope pocket, by folding a second closure flap on the rear panel upwardly along the flap fold line 127 into overlapping relation with the lower portion of the front panel 121, and sealing the second closure flap to the front panel by adhesive 133. The second closure flap is dimensioned so that it will cover the first mailing address indicia 143 and also any bar code that was applied in the bar code read area 136 on the front panel 121*a* during the initial mailing, but allows the entire return address inluding the lowermost line of the return address indicia 141 that extends into the mailing address read area to remain exposed. For this purpose, the second closure flap has an upper edge portion 126*a* which extends from the lower flap fold line 127 a distance less than the spacing of the upper read area limit 135*a* and such that the lowermost line of the return address indicia that extends into read area 135, remains exposed when the second closure flap is sealed to the front of the envelope. In order to aid in assuring that the first mailing address is completely covered, the second closure flap preferably has a second upper edge portion 126*b* that extends somewhat higher than the portion 126*a* and at least to the upper limit 135*a* of the mailing address read area. The illustrations of the two-way mailing envelope in FIGS. 8–13 are also on about a one-third scale. On full size envelopes, even of the minimum size, the mailing address indicia 143 are offset toward the right hand portion of the mailing address read area 135 while the return address indicia are located adjacent the left portion of the mailing address read area with the last line of the return address extending into the upper left portion of the read area.

The second closure flap is devoid of mailing address indicia at least in the area corresponding to the mailing address read area 135. During return mailing, the optical character reader of the automatic mail processing equipment will scan the return envelope beginning in the lower right hand corner and progress upwardly toward the upper left portion of the mailing address read area where it will read at least the zip code in the lowermost line of the return address indicia 141 that extends into the mailing address read area. The automatic mail processing equipment will then print a bar code in the clean bar code read area 136 provided by the second closure flap, in the lower right portion of the front of the envelope. The bar code represents the zip code of the original return address, and is used in further automated processing of the mail.

FIG. 14 illustrates a slightly modified form of the two-way mailing envelope of FIGS. 8–12. In this embodiment, the front panel 121 of the envelope is provided with a window 145 and the mailing address indicia 143' are printed on an enclosure that is inserted into the envelope during the initial mailing. When re-mailing, the second closure flap 126 covers the window opening 145, while leaving the return address indicia 141 exposed with the lower line of the return address indicia extending into the mailing address read area 135.

The embodiments of FIGS. 8–14 have several advantages in addition to those provided by the two-way mailing envelopes of FIGS. 1–7. It is only necessary to print return address indicia on the front panel of the envelope and it is unnecessary to provide re-mailing address indicia on the second closure flap. Accordingly, envelopes of the type illustrated in FIGS. 8–14 can be formed with a second closure flap inserted into the pocket between the front and rear panels, before any printing on the envelope. The return addresses can be printed on the envelope after the envelopes are folded and without requiring elaborate equipment. Instructions 140 similar to that described at 40 in the preceding embodiments, can be provided on the first closure flap or on the rear of the envelope, if desired.

From the foregoing it is thought that the manner of making and using the two-way mailing envelopes will be readily understood. The envelope and the return and mailing address indicia are so arranged that the second closure flap can be relatively short and have a height only sufficient to cover the original mailing address and any bar code printed on the front of the envelope during the first mailing. This short second closure flap not only reduces the amount of material required for making the envelope but also facilitates withdrawal of the second closure flap from the envelope pocket for re-mailing. The second closure flap is arranged in relation to the mailing address indicia so that during re-mailing it covers the original mailing address and any bar code on the front panel of the envelope. In the embodiment of FIGS. 1–8, the second closure flap has a re-mailing address for use during return mailing of the envelope. The embodiment of FIGS. 8–14 has additional advantages in that it eliminates the necessity of printing a re-mailing address on the second closure flap and instead utilizes the original return address while yet allowing the envelope to be processed by automatic mail processing equipment during the return mailing.

The embodiments of the invention in which an exclusive property or privilege is claimed are defined as follows:

1. A two-way mailing envelope adapted for either manual or automatic processing by mail processing machinery having optical character readers which can read address indicia in a preset OCR mailing address read area delimited by the U.S. Postal Service on the front of the envelope and print a bar code on a bar code read area on the front of the envelope below the preset OCR mailing address read area, the preset OCR mailing address read area having an upper read area limit spaced a preset distance above the lower edge of the envelope, the upper read area limit being spaced below the upper edge of the envelope to provide an upper area on the front of the envelope for a return address and for postage, the two-way mailing envelope being formed from a single elongated blank comprising a generally rectangular front panel having upper and lower side edges and end edges extending between its side edges and a generally rectangular rear panel having upper and lower side edges and end edges extending between its side edges, the front and rear panels being integrally joined at their upper side edges along a panel fold line, a first closure flap integrally joined to the lower side edge of the front panel, a second closure flap integrally joined to the lower side edge of the rear panel, means connected the front and rear panels together along their end edges to form a pocket, the front panel having printed mailing address indicia in the preset OCR mailing address read area and oriented to be right side up for visual and optical character reading when the envelope is oriented with the panel fold line at the top of the envelope, printed return address indicia on the front panel at a location offset to the left of the mailing address indicia and oriented to be right side up for visual and optical character reading when the envelope is oriented with the panel fold line at the top of the envelope, the return address indicia including a lowermost line located below the upper read area limit of the preset OCR mailing address read area and containing city, state and zip code of the return addressee, the return address indicia also including a return name and return delivery address in lines located above the upper read area limit of the preset OCR mailing address read area, the second closure flap being initially folded relative to the rear panel and inserted into the envelope pocket between the front and rear panels, the first closure flap being adapted to be folded relative to the front panel into overlapping relation with a portion of the rear panel and having first flap seal means for sealing the first closure flap to the rear panel for the first mailing of the envelope, the second closure flap being removable from the envelope pocket after the envelope is opened by rupturing the first closure flap, the second closure flap being foldable upwardly from the lower edge of the front panel into overlying relation with the lower portion of the front panel and having second flap seal means for sealing the second closure flap to the front panel of the envelope, the second closure flap being shaped and dimensioned such that, when folded upwardly into overlying relation to the lower portion of the front panel, it covers the bar code read area on the front panel and the mailing address indicia on the front panel and has a portion of its free upper edge disposed below the lowermost line of the return address indicia on the front panel of the envelope so that all of the return address indicia remains exposed for use in manual or automatic processing during return mailing.

2. A two-way mailing envelope according to claim 1 wherein the second closure flap has a stepped free edge with one upper edge portion arranged to extend at least to the upper read area limit of the preset OCR mailing address read area adjacent the right half portion of the front of the envelope and a second upper edge portion arranged to extend to a level below the upper read area limit in a left half portion of the front of the envelope sufficient to expose the lowermost line of the return address indicia.

3. A two-way mailing envelope according to claim 1 wherein the upper read area limit of the preset OCR mailing address read area is two and one quarter inches above the lower edge of the envelope and said portion of the free upper edge of the second closure flap is spaced about two inches above the lower edge of the envelope when the second closure flap is folded upwardly into overlying relation to the lower portion of the front panel.

4. A two-way mailing envelope according to claim 1 wherein the second closure flap has no printed address indicia on its outer face at least in the area corresponding to the reset OCR mailing address read area.

5. A two-way mailing envelope adapted for either manual or automatic processing by mail processing machinery having optical character readers which can read address indicia in a preset OCR mailing address read area delimited by the U.S. Postal Service on the front of the envelope and print a bar code on a bar code read area on the front of the envelope below the preset OCR mailing address read area, the mailing address read area having an upper read area limit spaced a preset distance above the lower edge of the envelope, the upper read area limit being spaced below the upper edge of the envelope to provide an upper area on the front of the envelope for a return address and for postage, the two-way mailing envelope being formed from a single elongated blank comprising a generally rectangular front panel having upper and lower side edges and end edges extending between its side edges and a generally rectangular rear panel having upper and lower side edges and end edges extending between its side edges, the front and rear panels being integrally joined at their upper side edges along a panel fold line, a first closure flap integrally joined to the lower side edge of the front panel, a second closure flap integrally joined to the lower side edge of the rear panel, means connecting the front and rear panels together along their end edges to form a pocket, the second closure flap being initially folded relative to the rear panel and inserted into the envelope pocket between the front and rear panels, the first closure flap being adapted to be folded relative to the front panel upwardly into overlapping relation with a lower portion of the rear panel and having first flap seal means for sealing the first closure flap to the rear panel for the first mailing of the envelope, the second closure flap being removable from the envelope pocket after the envelope is opened by rupturing the first closure flap and the second closure flap being adapted to be folded relative to the rear panel upwardly into overlapping relation with a lower portion of the front panel and having second flap seal means for sealing the second closure flap to the front panel of the envelope, the second closure flap being shaped an dimensioned such that, when folded upwardly into overlapping relation to the lower portion of the front panel, at least a portion of its upper free edge is spaced about one quarter of an inch below the upper read area limit of said preset OCR mailing address read area, printed return address indicia on the front panel oriented to be right side up for visual and optical character reading when the envelope is oriented with the panel fold line at the top of the envelope, the return address indicia including a lowermost line containing the city, state and zip code of the return address located below the upper read area limit of said preset OCR mailing address read area at a location to be above said portion of the free upper edge of the second closure flap when the latter is folded upwardly into overlapping relation with the lower portion of the front panel, the return address indicia also including a return name and return delivery address in lines located above the upper read area limit of the preset OCR mailing address read area, the front panel having printed mailing address indicia in said preset OCR mailing address read area and oriented to be right side up for visual and optical character reading when the envelope is oriented with the panel fold line at the top of the envelope, the mailing address indicia being offset to the right hand portion of the present OCR mailing address read area and including at least the mailing addressee's name, delivery address and city, state and zip code, with the city, state and zip code in the lowermost line of the mailing address, the second closure flap having no printed address indicia on its outer face at least in the area corresponding to the preset OCR mailing address area, and the second closure flap being shaped and dimensioned such that, when folded upwardly into overlapping relation to the lower portion of the front panel, it covers the bar code read area on the front panel and all of the mailing address indicia in the preset OCR read area on the front panel but has said portion of the free upper edge of the second closure flap disposed below the lowermost line of the return address whereby all of the return address indicia remains exposed for use in manual or automatic processing during return mailing.

6. A two-way mailing envelope according to claim 5 wherein the upper read area limit of the preset OCR mailing address read area is two and one quarter inches above the lower edge of the envelope and said portion of the free upper edge of the second closure flap is spaced about two inches above the lower edge of the envelope when the second closure flap is folded upwardly into overlapping relation with the lower portion of the front panel.

* * * * *

UNITED STATES PATENT AND TRADEMARK OFFICE

CERTIFICATE OF CORRECTION

PATENT NO. : 4,602,736

DATED : July 29, 1986

INVENTOR(S) : Arthur C. Barr

It is certified that error appears in the above-identified patent and that said Letters Patent are hereby corrected as shown below:

Claim 1, column 9, line 57, "connected" should be -- connecting --;

Claim 4, column 10, line 53, "reset" should be -- preset--;

Claim 5, column 11, line 26, "an" should be -- and --;

Column 12, line 12, "present" should be --preset--

Signed and Sealed this

Seventh Day of October, 1986

[SEAL]

*Attest:*

DONALD J. QUIGG

*Attesting Officer*

*Commissioner of Patents and Trademarks*